US009368305B2

(12) United States Patent
Lee

(10) Patent No.: US 9,368,305 B2
(45) Date of Patent: Jun. 14, 2016

(54) INSTANT TRIP DEVICE OF CIRCUIT BREAKER

(71) Applicant: LSIS CO., LTD., Anyang-si, Gyeonggi-do (KR)

(72) Inventor: Kwang Won Lee, Cheongju-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 14/532,878

(22) Filed: Nov. 4, 2014

(65) Prior Publication Data

US 2015/0179360 A1 Jun. 25, 2015

(30) Foreign Application Priority Data

Dec. 19, 2013 (KR) ..... 10-2013-0159510

(51) Int. Cl.

| | |
|---|---|
| ***H01H 71/10*** | (2006.01) |
| ***H01H 71/24*** | (2006.01) |
| ***H01H 3/28*** | (2006.01) |
| ***H01H 3/38*** | (2006.01) |

(52) U.S. Cl.

CPC ..... *H01H 71/10* (2013.01); *H01H 3/28* (2013.01); *H01H 3/38* (2013.01); *H01H 71/2472* (2013.01); *H01H 2071/249* (2013.01)

(58) Field of Classification Search

CPC ... H01H 2071/2427; H01H 3/28; H01H 3/38; H01H 71/2472; H01H 71/10; H01H 2071/249

USPC ..... 335/38, 174

See application file for complete search history.

(56) References Cited

U.S. PATENT DOCUMENTS 3,031,601 A * 4/1962 Rudolph ..... H01H 71/2472 335/27
6,218,920 B1 * 4/2001 Reichard ..... H01H 71/7463 335/172

(Continued)

FOREIGN PATENT DOCUMENTS

DE 2031958 1/1972
JP 57-12647 1/1982

(Continued)

OTHER PUBLICATIONS

European Patent Office Application Serial No. 14192456.3, Search Report dated Jun. 8, 2015, 8 pages.

(Continued)

*Primary Examiner* — Mohamad Musleh

(74) *Attorney, Agent, or Firm* — Lee Hong Degerman Kang & Waimey; Jonathan Kang; Jeffrey Lotspeich

(57) ABSTRACT

An instant trip device of a circuit breaker comprises a magnet; a supporter; an armature provided between the magnet and the supporter and including a rotation center portion and a rotating part is disposed to be rotatable with respect to the rotation center portion; and an armature spring configured to apply an elastic force in a direction where the rotating part of the armature becomes farther away from the magnet, wherein a groove of which one side is opened is formed at the supporter to support the rotation center portion, wherein a boss is formed at the rotation center portion to be inserted into the groove, and wherein the armature spring is an extension spring in which one end of the armature spring is supported by a first hanger included in the supporter, and the other end is supported by a second hanger included in the rotating part.

4 Claims, 8 Drawing Sheets

(56) References Cited

U.S. PATENT DOCUMENTS

| | | | | |
|---|---|---|---|---|
| 6,556,111 | B2 * | 4/2003 | Felden | H01H 71/446 335/172 |
| 6,744,339 | B2 * | 6/2004 | Daehler | H01H 71/2472 335/35 |
| 6,774,749 | B2 * | 8/2004 | Raabe | H01H 71/2472 335/23 |
| 2003/0053274 | A1 | 3/2003 | Raabe et al. | |
| 2003/0174033 | A1 | 9/2003 | Daehler et al. | |
| 2003/0197581 | A1 * | 10/2003 | O'Keeffe | H01H 71/2436 335/172 |
| 2004/0150495 | A1 * | 8/2004 | Lias | H01H 71/2472 335/2 |
| 2009/0115556 | A1 * | 5/2009 | Faik | H01H 71/7463 335/42 |
| 2013/0187735 | A1 | 7/2013 | Augusta et al. | |
| 2013/0187746 | A1 * | 7/2013 | Augusta | H01H 89/00 337/3 |

FOREIGN PATENT DOCUMENTS

| | | |
|---|---|---|
| JP | 62-70341 | 5/1987 |
| JP | 2001-68009 | 3/2001 |
| JP | 2001-236873 | 8/2001 |
| KR | 20-0393291 | 8/2005 |
| KR | 10-2012-0071937 | 7/2012 |

OTHER PUBLICATIONS

Korean Intellectual Property Office Application Serial No. 10-2013-0159510, Notice of Allowance dated May 27, 2015, 2 pages.

Korean Intellectual Property Office Application Serial No. 10-2013-0159510, Office Action dated Nov. 13, 2014, 4 pages.

Japan Patent Office Application Serial No. 2014-244814, Office Action dated Sep. 29, 2015, 2 pages.

* cited by examiner

INSTANT TRIP DEVICE OF CIRCUIT BREAKER

CROSS-REFERENCE TO RELATED APPLICATION

Pursuant to 35 U.S.C. §119(a), this application claims the benefit of earlier filing date and right of priority to Korean Application No. 10-2013-0159510, filed on Dec. 19, 2013, the contents of which are all hereby incorporated by reference herein in its entirety.

BACKGROUND OF THE DISCLOSURE

1. Field of the Disclosure

The present disclosure relates to an instant trip device of a circuit breaker, and particularly, to an instant trip device of a circuit breaker, which can secure a reliability of an instant operation and reduce the cost.

2. Background of the Disclosure

Generally, breaker circuits are a type of electronic device that manually switches on or off an electric circuit by using a handle, or when a fault current such as a short circuit current occurs, detects the fault current to automatically break the electric circuit, thereby protecting a load device and the electric circuit.

FIG. 1 is a cross-sectional view illustrating a relate art circuit breaker. FIG. 2 is a main cross-sectional view illustrating an instant trip device and a crossbar of FIG. 1. FIG. 3 is a perspective view illustrating an assembly process of the instant trip device of FIG. 3. FIG. 4 is a perspective view illustrating an assembly completion state of FIG. 3.

As illustrated in FIGS. 1 to 4, the related art circuit breaker includes a case 10, a fixed contact 20 that is fixedly disposed at the case 10, a moving contact 30 that is disposed to be contactable with and detachable from the fixed contact 20, a switching mechanism 40 that switches on or off the moving contact 30, and an instant trip device 60 that, when a fault current such as a short circuit current occurs, detects the fault current and automatically triggers the switching mechanism 40 in order for the switching mechanism 40 to move to a tripping position within a momentary time. A handle 50 is further provided in an upper region of the case 10 so as to manually switch on or off the switching mechanism 40.

The instant trip device 60 includes a magnet 62 that generates a magnetic absorbing force in exciting, an armature 66 that is disposed at one side of the magnet 62 and is absorbed by the magnet 62, a supporter 64 that rotatably supports the armature 66 at an opposite side of the magnet 62 with respect to the armature 66, and an armature spring 68 that applies an elastic force in a direction where the armature 66 becomes farther away from the magnet 62.

The armature 66 includes a first moving plate 66*a* and a second moving plate 66*b* that is bent to be approximately vertical to the first moving plate 66*a*. The second moving plate 66*b* includes a shaft hole 66*d* into which a shaft 69 is inserted.

The supporter 64 includes a first fixed plate 64*a* and a second fixed plate 64*b* that is bent to be approximately vertical to the first fixed plate 64*a*. The second fixed plate 64*b* includes a shaft supporting part 64*c* that rotatably supports the armature 66. A shaft inserting hole 64*d*, into which the shaft 69 is inserted, is formed at the shaft supporting part 64*c*.

The armature spring 68 is a double torsion spring, and a coil 68*d* passes through the armature spring 68 by the shaft 69. One end of the armature spring 68 is supported by the supporter 64, and the other end is supported by the armature 66.

A crossbar 71, a trip shooter 73, a trip bar 75, and a latch holder 77 are provided at one side of the armature 66. When the armature 66 is rotated by the magnet 62, the crossbar 71, the trip shooter 73, the trip bar 75, and the latch holder 77 perform a function (a trigger function) of binding a latch (not shown) of the switching mechanism 40 and releasing the binding of the latch.

Due to such a configuration, when a fault current flows through the magnet 62, the magnet 62 is magnetized to generate a magnetic absorbing force. When the magnetic absorbing force is greater than a weight of the armature spring 68, the armature 66 is absorbed to the magnet 62 side, and is rotated. When the armature 66 is rotated to rotate the crossbar 71, the trip shooter 73, the trip bar 75, and the latch holder 77 are continuously rotated to bind the latch (not shown) of the switching mechanism 40 and release the binding of the latch. When the binding of the latch (not shown) is released, the moving contact 30 is quickly detached from the fixed contact 20 by an elastic force of a trip spring (not shown) of the switching mechanism 40.

However, in the instant trip device 60 of the related art circuit breaker, the shaft inserting hole 64*d* of the supporter 64, the shaft hole 66*d* of the armature 66, and the coil 68*d* of the armature spring 68 are disposed in one row on the same axis, and the shaft 69 is inserted to pass through the elements, whereby the instant trip device is assembled. For this reason, an assembly process is complicated, causing a reduction in assemblability.

Moreover, in the related art instant trip device 60, a problem of scattering, a problem of distortion, and a problem of obstructing a movement of the armature are caused by an accumulation tolerance between the shaft inserting hole 64*d* of the supporter 64, the shaft hole 66*d* of the armature 66, the coil 68*d* of the armature spring 68, and the shaft 69. For this reason, a reliability of an instant operation is reduced.

Moreover, in the related art instant trip device 60, the shaft 69 deviates from a normal position when an element is moved and kept.

Moreover, in the related art instant trip device 60, the number of elements increases due to the separate use of the shaft 69, and the cost increases due to the use of an expensive double torsion spring.

SUMMARY OF THE DISCLOSURE

Therefore, an aspect of the detailed description is to provide an instant trip device of a circuit breaker in which a structure is simplified, and thus, assemblability can be enhanced.

Another aspect of the detailed description is to provide an instant trip device of a circuit breaker, which solves a problem of scattering, a problem of distortion, and a problem of obstructing a movement of an armature, thereby enhancing a reliability of an instant operation.

Another aspect of the detailed description is to provide an instant trip device of a circuit breaker, which solves a problem in which a shaft deviates from a normal position.

Another aspect of the detailed description is to provide an instant trip device of a circuit breaker in which the number of elements and the cost are reduced.

To achieve these and other advantages and in accordance with the purpose of this specification, as embodied and broadly described herein, an instant trip device of a circuit breaker includes: a magnet configured to generate a magnetic absorbing force with power applied thereto; a supporter disposed at a side opposite to the magnet; an armature provided between the magnet and the supporter, and including a rotation center portion and a rotating part is disposed to be rotatable with respect to the rotation center portion; and an armature spring configured to apply an elastic force in a direction where the rotating part of the armature becomes farther away from the magnet, wherein a groove of which one side is opened is formed at the supporter to support the rotation center portion of the armature, wherein a boss is formed at the rotation center portion of the armature to be inserted into the groove, and wherein the armature spring is an extension spring in which one end of the armature spring is supported by a first hanger included in the supporter, and the other end is supported by a second hanger included in the rotating part of the armature.

The opened one side of the groove may be formed in a direction of the rotating part.

The first hanger may be provided at a position which is more adjacent to the groove than the second hanger, and an elastic force may be applied in a direction where a contact state between the groove and the boss is maintained.

The supporter may include a spring accommodating part which is formed at a side of the first hanger to pass through the supporter, so that there is no interference between the supporter and the armature spring.

A portion of the groove which is pressured by the boss may be formed in a semicircular shape, the boss may be formed in a cylindrical shape, and a curvature radius of the semicircular portion of the groove may be equal to or greater than a radius of the boss.

A pair of the bosses may be provided on a rotating axis of the armature to be symmetric with respect to the armature, and a pair of the grooves may be provided in correspondence with the pair of bosses.

Further scope of applicability of the present application will become more apparent from the detailed description given hereinafter. However, it should be understood that the detailed description and specific examples, while indicating preferred embodiments of the disclosure, are given by way of illustration only, since various changes and modifications within the spirit and scope of the disclosure will become apparent to those skilled in the art from the detailed description.

BRIEF DESCRIPTION OF THE DRAWINGS

The accompanying drawings, which are included to provide a further understanding of the disclosure and are incorporated in and constitute a part of this specification, illustrate exemplary embodiments and together with the description serve to explain the principles of the disclosure.

In the drawings:

FIG. 8 is seen from the armature.

DETAILED DESCRIPTION OF THE DISCLOSURE

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, embodiments of the present invention will be described in detail with reference to the accompanying drawings.

Figure 1:
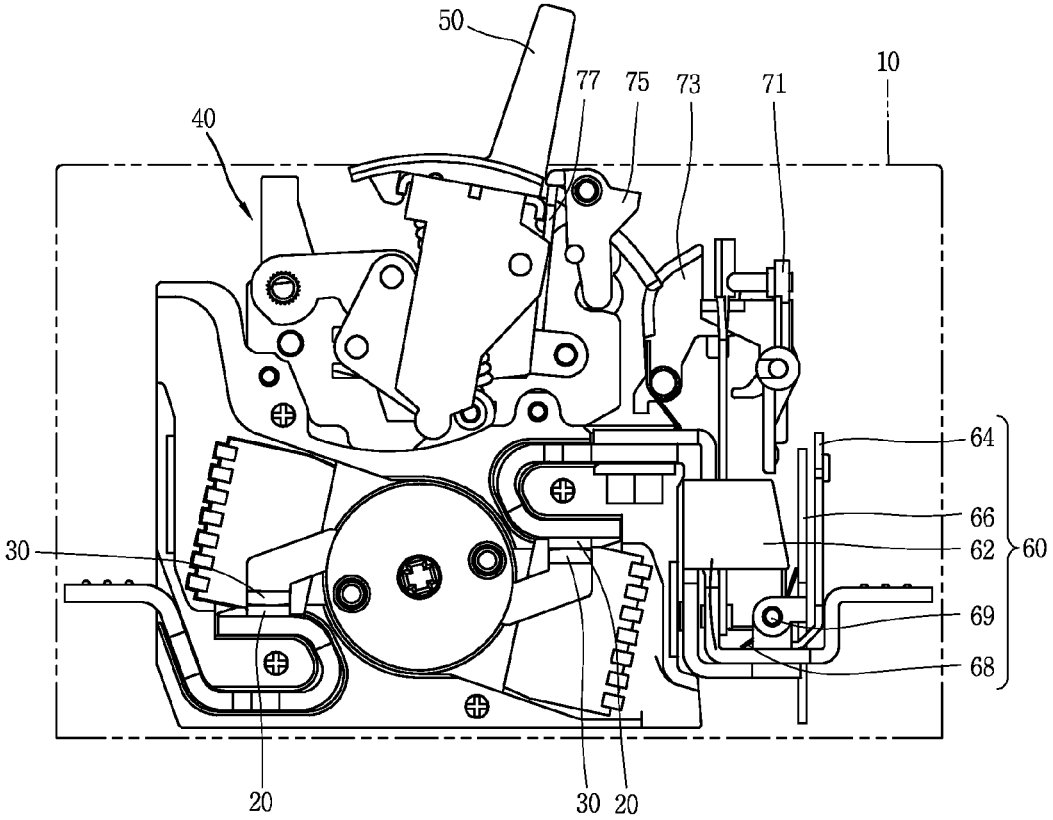
FIG. 1 RELATED ART
FIG. 1 is a cross-sectional view illustrating a relate art circuit breaker.
Figure 2:
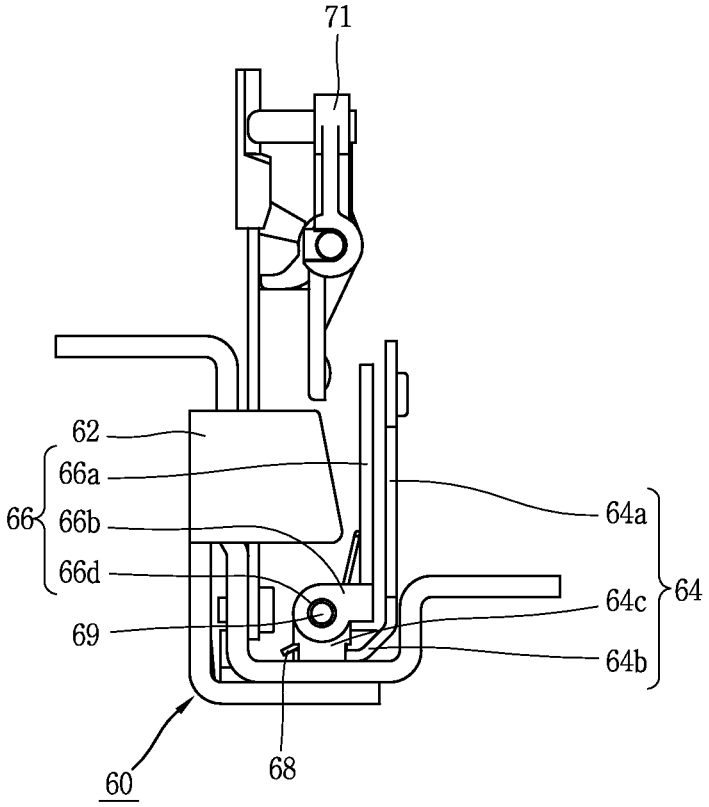
FIG. 2 RELATED ART
FIG. 2 is a main cross-sectional view illustrating an instant trip device and a crossbar of FIG. 1.
Figure 3:
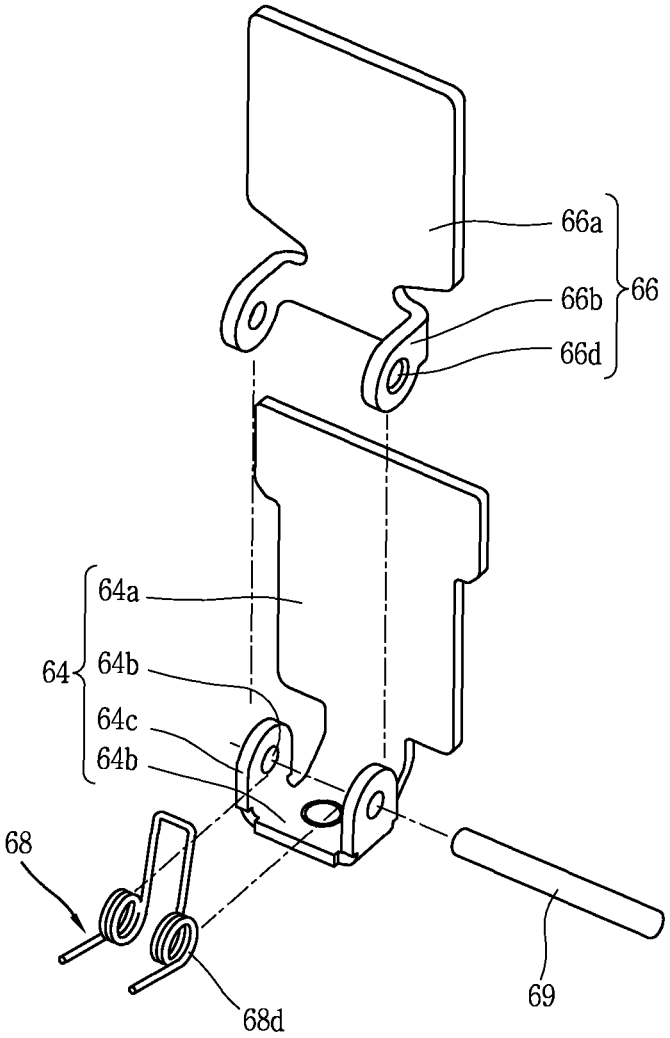
FIG. 3 RELATED ART
FIG. 3 is a perspective view illustrating an assembly process of the instant trip device of FIG. 3.
Figure 4:
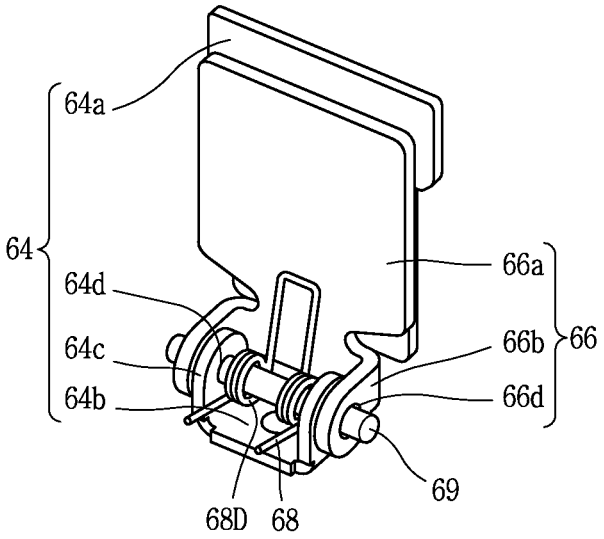
FIG. 4 RELATED ART
FIG. 4 is a perspective view illustrating an assembly completion state of FIG. 3.
Figure 5:
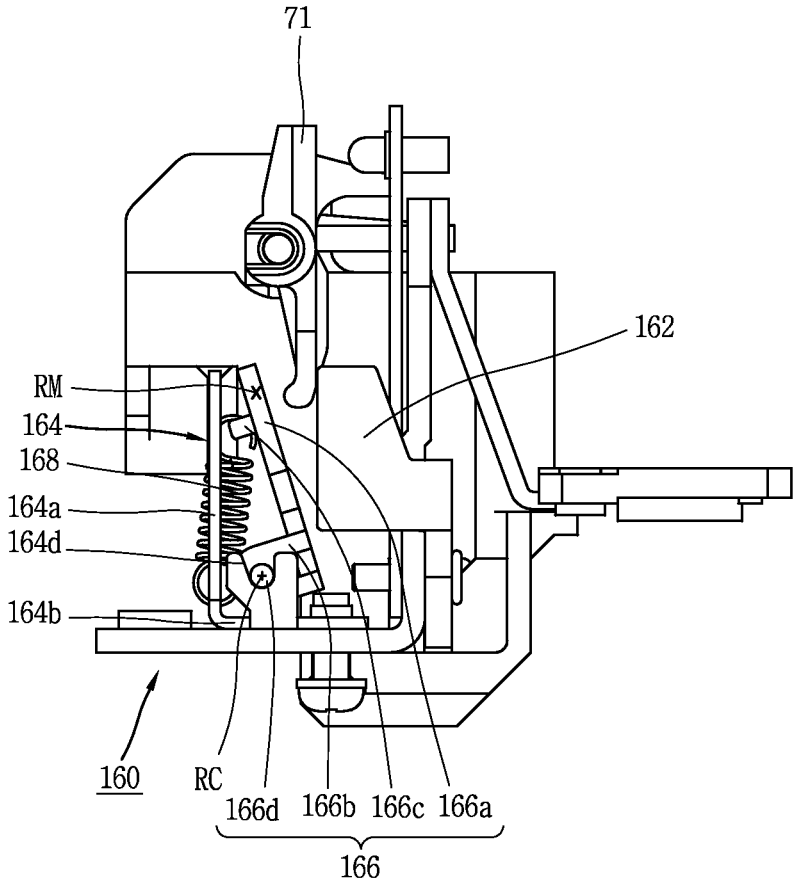
FIG. 5 is a main cross-sectional view illustrating an instant trip device and a crossbar according to an embodiment of the present invention.
Figure 6:
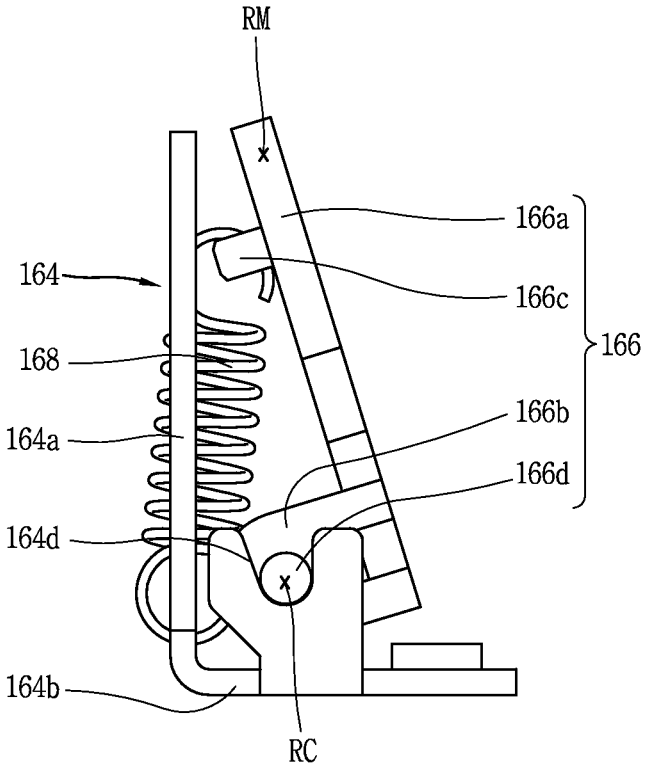
FIG. 6 is a main cross-sectional view illustrating an armature assembly of the instant trip device of FIG. 5.
Figure 7:
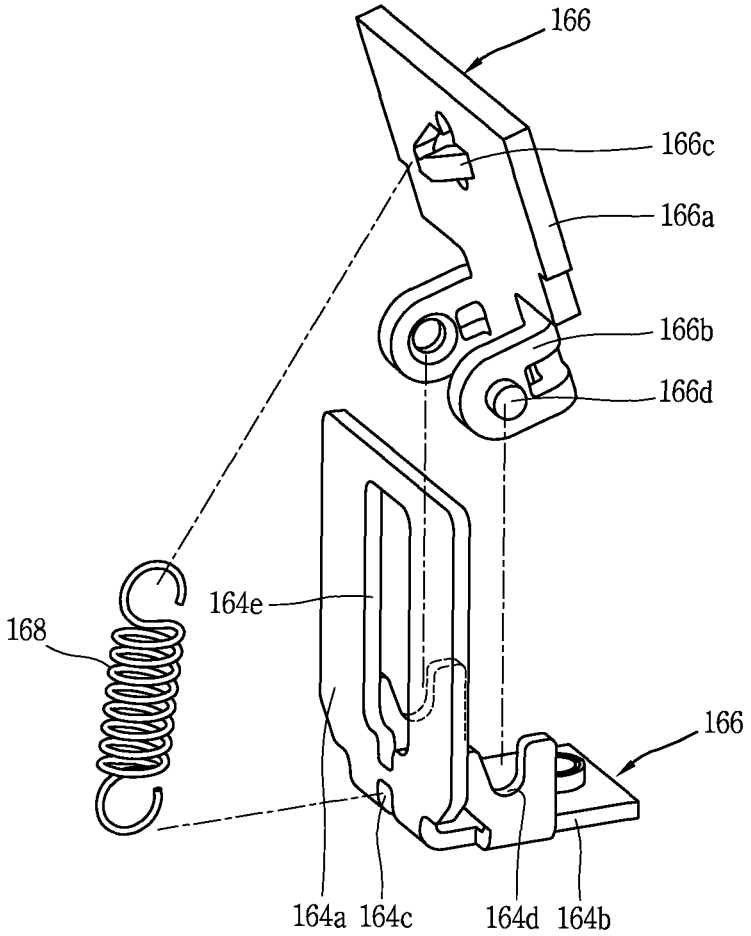
FIG. 7 is a perspective view illustrating an assembly process of the armature assembly of FIG. 6.
Figure 8:
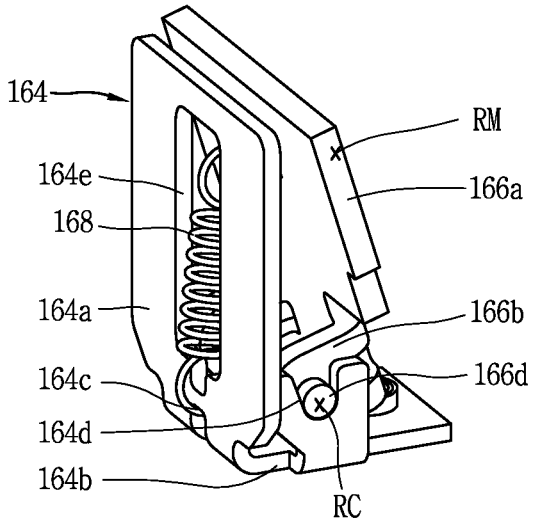
FIG. 8 is a perspective view illustrating an assembly completion state of FIG. 6.
Figure 9:
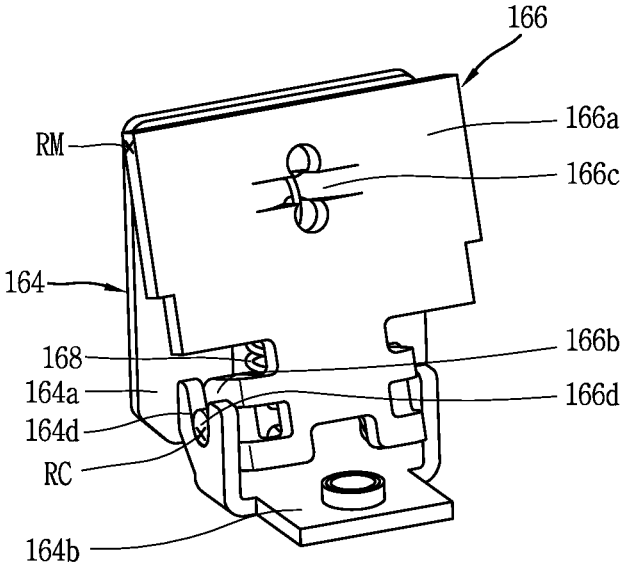
FIG. 9 is a perspective view when

FIG. 5 is a main cross-sectional view illustrating an instant trip device and a crossbar according to an embodiment of the present invention. FIG. 6 is a main cross-sectional view illustrating an armature assembly of the instant trip device of FIG. 5. FIG. 7 is a perspective view illustrating an assembly process of the armature assembly of FIG. 6. FIG. 8 is a perspective view illustrating an assembly completion state of FIG. 6. FIG. 9 is a perspective view when FIG. 8 is seen from the armature.

As seen in FIGS. 5 to 9, an instant trip device 160 according to an embodiment of the present invention may include a magnet 162 that generates a magnetic absorbing force with power applied thereto, a supporter 164 that is disposed at a side opposite to the magnet 162, an armature 166 in which a rotating part RM is disposed to be rotatable in a first direction and a second direction with respect to a rotation center portion RC and between the magnet 162 and the supporter 164, and an armature spring 168 that applies an elastic force in a direction where the rotating part RM of the armature 166 becomes farther away from the magnet 162.

For reference, a mechanism configured with the supporter 164, the armature 166, and the armature spring 168 is referred to as an armature assembly.

The magnet 162 may be connected to a fixed contact (not shown) so as to enable electricity to be conducted.

The supporter 164 may include a first fixed plate 164*a* and a second fixed plate 164*b* which is bent to be approximately vertical to the first fixed plate 164*a*.

The first fixed plate 164*a* may include a first hanger 164*c* and a spring accommodating part 164*e*.

The first hanger 164*c* may be formed of a groove so that one end of the armature spring 186 is hanged on a lower side of the first fixed plate 164*a*. In other words, the first hanger 164*c* may be formed of a groove so that the one end of the armature spring 168 is hanged on a position adjacent to a below-described boss accommodating groove 164*d* of the first fixed plate 164*a*.

The spring accommodating part 164*e* may be formed of a groove, which passes through the first fixed plate 164*a*, at a side of the first hanger 164*c* so that there is no interference between the first fixed plate 164*a* and the armature spring 168 when the armature assembly is assembled.

The second fixed plate 164*b* may include a pair of grooves 164*d* (hereinafter referred to as a boss accommodating groove) of which one side is opened.

A below-described boss 166*d* of the armature 166 may be inserted into the boss accommodating groove 164*d*, and thus, the rotation center portion RC of the armature 166 may be provided in the boss accommodating groove 164*d*. In this case, the boss accommodating groove 164*d* may be formed in a U-shape where one side of the boss accommodating groove 164*d* is opened in a direction from the rotation center portion CM to the rotating part RM, and a portion which is pressured by the boss 166*d* has a semicircular shape.

The first hanger 164*c* may be provided under the first fixed plate 164*a* with respect to a below-described second hanger 166*c*. In other words, the first hanger 164*c* may be more adjacent to the boss accommodating groove 164*d* than the below-described second hanger 166*c*, and may be provided at a position opposite to the magnet 162 with respect to the boss accommodating groove 164*d*.

The armature 166 may include a first moving plate 166*a* that is the rotating part RM and a second moving plate 166*b* that is bent to be approximately vertical to the first moving plate 166*a*.

The second hanger 166*c*, which is formed in a groove form, may be provided at one side of the first moving plate 166*a* so that the other end of the armature spring 168 is hanged on the second hanger 166*c*.

The second moving plate 166*b* may include a pair of bosses 166*d* which are inserted in the boss accommodating groove 164*d* of the supporter 164, and are formed in a cylindrical shape so as to configure the rotation center portion RC.

In this case, in order for the armature 166 to smoothly rotate, the boss 166*d* may be formed in a cylindrical shape, the boss accommodating groove 164*d* may be formed in a U-shape where the portion which is pressured by the boss 166*d* has a semicircular shape, and a curvature radius of a semicircular portion of the boss accommodating groove 164*d* may be equal to or greater than a radius of a circular cross-sectional surface of the boss 166*d*. However, when it is possible for armature 166 to rotate, the boss 166*d* and the boss accommodating groove 164*d* may be formed in different shapes.

Moreover, the pair of bosses 166*d* may be provided on a rotating axis of the armature 166 to be symmetric with respect to the armature 166, and in correspondence with the pair of bosses 166*d*, the pair of boss accommodating grooves 164*d* may be provided on the rotating axis of the armature 166 to be symmetric with respect to the supporter 164.

The armature spring 168 is an extension spring. One end of the armature spring 168 may be supported by the first hanger 164*c*, and the other end may be supported by the second hanger 166*c*.

In the drawings, like reference numerals refer to like elements.

Hereinafter, an operation and effects of the instant trip device 160 of the circuit breaker according to an embodiment of the present invention will be described in detail.

The instant trip device 160 of the circuit breaker according to an embodiment of the present invention may be sequentially assembled through the following process. That is, the boss 166*d* which is formed as one body with the armature 166 may be inserted into and accommodated in the boss accommodating groove 164*d*, and thus, the armature 166 may be rotatably coupled to the supporter 164. One end of the armature spring 168 may be hanged on the first hanger 164*c*, and the other end may be hanged on the second hanger 166*c*. Therefore, a coupled state of the armature 166 and the supporter 164 is maintained, and the magnet 162 which is separately provided may be coupled thereto.

In the instant trip device 160 which is assembled in this way, a contact state between the boss accommodating groove 164*d* of the supporter 164 and the boss 166*d* of the armature 166 may be normally maintained by an elastic force of the armature spring 168. In other words, in the instant trip device 160, a rotatable coupling state between the supporter 164 and the armature 166 may be normally maintained by the elastic force of the armature spring 168. Also, in the instant trip device 160, due to the elastic force of the armature spring 168, the rotating part RM of the armature 166 may become farther away from the magnet 162, but a state of being supported by the first fixed plate 164*a* of the supporter 164 may be maintained.

When a fault current such as a short circuit current occurs in a circuit, the magnet 162 may be magnetized to generate a magnetic absorbing force. When the magnetic absorbing force is greater than a weight of the armature spring 168, the first moving plate 166*a* of the armature 166 may be absorbed to the magnet 162 side, and may be rotated. In other words, when the magnetic absorbing force is greater than the weight of the armature spring 168, the rotating part RM of the armature 166 may clockwise rotate in FIG. 5. When the armature clockwise rotates in FIG. 5, the latch (not shown) of the switching mechanism (not shown) may be bound, and the binding of the latch may be released. When the binding of the latch is released, a moving contact (not shown) may be quickly detached from a fixed contact (not shown).

Here, in the instant trip device 160 of the circuit breaker according to an embodiment of the present invention, the rotation center portion RC of the armature 166 may be implemented by the boss accommodating groove 164*d* with one side opened of the supporter 164 and the boss 166*d* which is formed as one body with the armature 166. Also, in the instant trip device 160 of the circuit breaker according to an embodiment of the present invention, an elastic force may be applied in a direction where the armature 166 deviates from the magnet 162 due to the armature spring 168, and a rotatable coupling state between the supporter 164 and the armature 166 may be maintained by the armature spring 168.

Due to such a configuration, in the instant trip device 160 of the circuit breaker according to the embodiments of the present invention, a structure is simplified, and thus, assemblability can be enhanced. Also, the instant trip device 160 of the circuit breaker according to the embodiments of the present invention solves a problem of scattering, a problem of distortion, and a problem of obstructing a movement of an armature, which are caused by the accumulation tolerance of the rotation center portion, thereby enhancing a reliability of an instant operation. Also, when an element is moved and kept, the instant trip device 160 of the circuit breaker according to the embodiments of the present invention can solve a problem in which the shaft deviates from a normal position and which is caused by the separate use of the shaft. Also, the number of elements and the cost are reduced compared to the related art.

In addition to the instant trip device 160 according to an embodiment of the present invention, other elements, operations, and effects of the circuit breaker are the same as those of the related art, and thus, their detailed descriptions are not provided.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. An instant trip device of a circuit breaker, the instant trip device comprises:

a magnet configured to generate a magnetic absorbing force with power applied thereto;

a supporter disposed at a side opposite to the magnet;

an armature is provided between the magnet and the supporter, and including a rotation center portion and a rotating part is disposed to be rotatable with respect to the rotation center portion; and an armature spring configured to apply an elastic force in a direction where the rotating part of the armature becomes farther away from the magnet, wherein, a groove of which one side is opened is formed at the supporter to support the rotation center portion of the armature, a boss is formed at the rotation center portion of the armature to be inserted into the groove, and the armature spring is an extension spring in which one end of the armature spring is supported by a first hanger included in the supporter, and the other end is supported by a second hanger included in the rotating part of the armature, wherein the opened one side of the groove is formed in a direction of the rotating part, wherein the supporter comprises a spring accommodating part which is formed at a side of the first hanger to pass through the supporter, so that there is no interference between the supporter and the armature spring.

2. The instant trip device of claim 1, wherein the first hanger is provided at a position which is more adjacent to the groove than the second hanger, and an elastic force is applied in a direction where a contact state between the groove and the boss is maintained.

3. The instant trip device of claim 1, wherein, a portion of the groove which is pressured by the boss is formed in a semicircular shape, the boss is formed in a cylindrical shape, and a curvature radius of the semicircular portion of the groove is equal to or greater than a radius of the boss.

4. The instant trip device of claim 1, wherein, a pair of the bosses are provided on a rotating axis of the armature to be symmetric with respect to the armature, and a pair of the grooves are provided in correspondence with the pair of bosses.

* * * * *